US005494766A

United States Patent [19]

Dohi et al.

[11] Patent Number: 5,494,766

[45] Date of Patent: Feb. 27, 1996

[54] ELECTROPHOTOGRAPHIC PHOTORECEPTOR

[75] Inventors: Kazuhito Dohi; Hajime Suzuki, both of Kofu, Japan

[73] Assignees: Shindengen Electric Manufacturing Co., Ltd., Tokyo; Yamanashi Electronics Co., Ltd., Yamanashi, both of Japan

[21] Appl. No.: 341,143

[22] Filed: Nov. 16, 1994

[30] Foreign Application Priority Data

Dec. 24, 1993 [JP] Japan ..... 5-327914

[51] Int. Cl.[6] ..... G03G 5/09; G03G 5/047

[52] U.S. Cl. ..... 430/59; 430/83

[58] Field of Search ..... 430/59, 83

[56] References Cited

U.S. PATENT DOCUMENTS 4,925,759 5/1990 Hanatani et al. ..... 430/59

5,399,453 3/1995 Dohi et al. ..... 430/59

FOREIGN PATENT DOCUMENTS 1118141A 5/1989 Japan .

*Primary Examiner*—Roland Martin

*Attorney, Agent, or Firm*—Stevens, Davis, Miller & Mosher

[57] ABSTRACT

An electrophotographic photoreceptor which is excellent in various properties, has effectively inhibited photo-induced fatigue and has stability against repeated use, and which comprises an electroconductive support and a photosensitive layer comprising as essential components a charge-generating material and a diaminodiphenyl compound represented by the general formula (I):

[I]

13 Claims, 2 Drawing Sheets

ELECTROPHOTOGRAPHIC PHOTORECEPTOR

BACKGROUND OF THE INVENTION

This invention relates to an electrophotographic photoreceptor having a photosensitive layer comprising a diaminodiphenyl compound as an essential component.

As photoconductive materials for electrophotographic photoreceptors, there have heretofore been generally used inorganic materials such as selenium, selenium.tellurium, diarsenic triselenide, cadmium sulfide, zinc oxide, amorphous silicon and the like. However, these photoreceptors have such disadvantages that it is poor in practical flexibility, it is sensitive to heat and mechanical impact and it is high in production cost. Recently, a photoreceptor in which an organic material is utilized to overcome the above disadvantages has been proposed and used in practice. As this organic photoreceptor, there have been widely known a socalled function-separated type organic photoreceptor in which a charge-generating layer and a charge-transfer layer are laminated to each other and to an electroconductive support and a dispersion type organic photoreceptor in which a photosensitive layer which serves as the above two layers is laminated to an electroconductive support.

Known function-separated type organic photoreceptors are those in which a charge-generating layer containing a cyanine pigment or the like as an effective component and a charge-transfer layer containing an organic compound of a hydrazone type, a pyrrazoline type, an oxadiazole type or the like are laminated to each other and to a support, and it has been known that many compounds are effective as the charge-generating material and charge-transfer material.

In such a function-separated type organic photoreceptor, the charge-generating material absorbs light in the charge-generating layer to generate a carrier, and the carrier generated is injected into the charge-transfer layer and moved in the charge-transfer layer. In this case, however, it is important to select such a material that the carrier can be moved to the surface without being trapped with impurities or the like in the charge-transfer layer. The electrophotographic characteristics of the above function-separated type organic electrophotographic photoreceptor are greatly varied depending on the combination of the charge-generating material and the charge-transfer material.

However, as a result of experiments on many compounds, it has been known that when a combination of a charge-generating layer with a charge-transfer layer is made a photosensitive layer, only a few of the compounds satisfy the characteristics and conditions practically required for the photoreceptor. In particular, few compounds can satisfy the charge-exposure repeating characteristics in the known electrophotographic process, and when charge and exposure are repeated, the residual potential which is considered to result from accumulation of trapped carrier in the charge-transfer layer increases, whereby the image becomes apt to be foggy. This is inferred to be due to photo-induced fatigue. A problem similar to the above-mentioned problem is also caused in the case of a dispersion type organic photoreceptor in which a binder resin having dispersed therein a phthalocyanine pigment, a bisazo pigment or the like is coated on a support.

The present inventors have made extensive research on a method for preventing the photolysis of photoreceptor due to repeated use and the elevation of residual potential accompanying the photo-induced fatigue and have repeated experiments. As a result, they have found that when a photosensitive layer comprising a specific diaminodiphenyl compound as an essential component is provided on an electroconductive support, the characteristics as an organic electrophotographic photoreceptor are extremely excellent, whereby the above-mentioned problems have been solved.

SUMMARY OF THE INVENTION

It is an object of this invention to provided an organic electrophotographic photoreceptor freed from the above-mentioned disadvantages of the prior art.

It is another object of this invention to provide an organic electrophotographic photoreceptor having a photosensitive layer comprising a diaminodiphenyl compound as an essential component.

Other objects and advantages of this invention will become apparent from the following description and the accompanying drawings.

According to this invention, there is provided an organic electrophotographic photoreceptor comprising an electroconductive support having provided thereon a photosensitive layer comprising as essential components a charge-generating material and at least one diaminodiphenyl compound represented by the general formula (I):

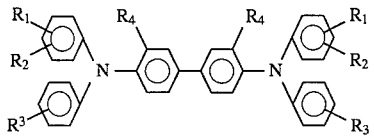

[I]

wherein the two $R_1$ groups may be the same as or different from each other and each represents a halogen atom, an alkyl group preferably having 1 to 18 carbon atoms, more preferably 1 to 8 carbon atoms, an alkoxy group preferably having 1 to 18 carbon atoms, more preferably 1 to 8 carbon atoms, an aralkyl group preferably having 7 to 18 carbon atoms, more preferably 7 to 12 carbon atoms, a phenyl group or a phenyl group substituted by a lower alkyl or alkoxy group having 1 to 5 carbon atoms; the two $R_2$ groups may be the same as or different from each other and each represents a halogen atom, an alkyl group, an alkoxy group, an aralkyl group, a cycloalkyl group, a phenyl group or a phenyl group substituted by a lower alkyl or alkoxy group; the two $R_3$ groups may be the same as or different from each other and each represents a hydrogen atom, a halogen atom, an alkyl group, an alkoxy group or an aralkyl group; the two $R_4$ groups may be the same as or different from each other and each represents a hydrogen atom, a chlorine atom, a methyl group or a methoxy group; and $R_1$ and $R_2$ are different from each other.

When the photosensitive layer contains the above compound, excellent characteristics as an organic photoreceptor are exhibited.

DETAILED DESCRIPTION OF THE INVENTION

Specific examples of the diaminodiphenyl compound represented by the general formula (I) used in this invention include those shown in Table 1.

TABLE 1

Examples of diaminodiphenyl compounds of formula (I)

| | $R_1$ | $R_2$ | $R_3$ | $R_4$ |
|---|---|---|---|---|
| (1) | 2-$OCH_3$ | 4-$CH_3$ | H | H |
| (2) | 2-$CH_3$ | 4-$OCH_3$ | H | H |
| (3) | 2-Phenyl | 4-$OCH_3$ | $CH_3$ | H |
| (4) | 3-$CH_3$ | 6-$C_2H_5$ | $CH_3$ | $CH_3$ |
| (5) | 2-$C_{15}H_{31}$ | 4-$OCH_3$ | $CH_3$ | $CH_3$ |
| (6) | 3-Cl | 4-$CH_3$ | $CH_3$ | $CH_3$ |

The above diaminodiphenyl compounds may be used alone or even in combination of two or more.

As the layer construction of an organic electro-photographic photoreceptor, various types are known, and the organic electrophotographic photoreceptor of this invention may have any of the known layer constructions.

Figure 4:
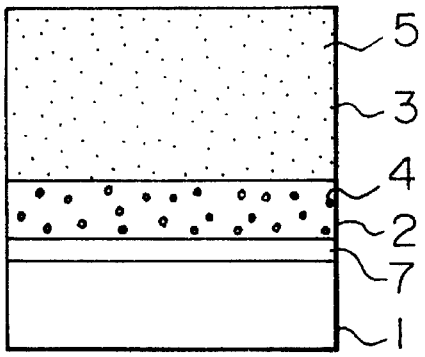
FIG. 4 is a cross-sectional view of a further example of the organic electrophotographic photoreceptor and shows the same structure as FIG. 1 but having further an intermediate layer formed between the electroconductive support 1 and the charge-generating layer 2.
Figure 5:
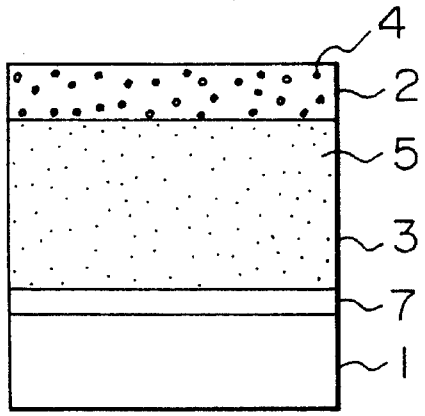
FIG. 5 is a cross-sectional view of a still further example of the organic electrophotographic photoreceptor of this invention and shows the same structure as FIG. 2 but having further an intermediate layer formed between the electroconductive support 1 and the charge-transfer layer 3.
Figure 6:
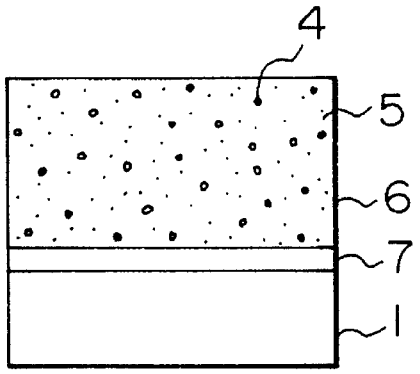
FIG. 6 is a sectional view of still another example of the organic electrophotographic photoreceptor of this invention and shows the same structure as FIG. 3 but having further an intermediate layer formed between the electroconductive support 1 and the photosensitive layer 6.

In the organic photoreceptor of this invention, if necessary, an intermediate layer 7 may be provided on the electroconductive support 1 as shown in FIGS. 4 to 6 in order to prevent free charges from being injected from the electroconductive support into the photosensitive layer when the photosensitive layer is charged and to obtain an action as an adhesive layer which allows the photosensitive layer to adhere integrally to the electroconductive support. This intermediate layer may be composed of at least one member selected from the group consisting of titanium oxide, aluminum oxide, indium oxide, tin oxide, a polyethylene, an acrylic resin, an epoxy resin, a polycarbonate, a polyurethane, a vinyl chloride resin, a vinyl acetate resin, a polyvinyl alcohol, a polyamide resin and the like. The thickness of the intermediate layer or adhesive layer is preferably 0.1 to 5 μm, more preferably 0.5 to 3 μm.

The support to be used in the organic electrophotographic photoreceptor of this invention may be made of any electroconductive material, which includes specifically plastics having vapor-deposited thereon or laminated thereto a metal such as aluminum, copper, stainless steel, brass or the like; tin oxide; or the like. The shape of the support may be any of the sheet, belt, drum and other shapes.

The organic electrophotographic photoreceptor of this invention can be prepared by applying to an electroconductive support a coating solution prepared by dissolving or dispersing at least one diaminodiphenyl compound represented by the general formula (I) together with a binder in a suitable solvent and a photoconductive material, and adding, if necessary, an electron attractive compound or the other photoconductive material; and drying the same to form a photosensitive layer having a thickness of preferably 5 to 40 μm, more preferably 6 to 20 μm.

Figure 1:
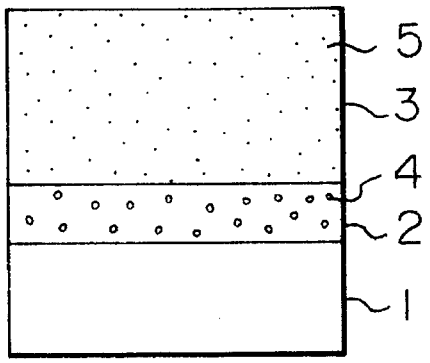
FIG. 1 is a cross-sectional view of an example of the organic electrophotographic photoreceptor of this invention and shows that the photosensitive layer has a negatively charged, function-separated double layer structure in which a charge-generating layer 2 comprising a charge-generating material as an essential component is formed on an electroconductive support 1 and a charge-transfer layer 3 comprising, as an essential component, a charge-transfer material consisting of a diaminodiphenyl compound is formed on the opposite side of the charge-generating layer 2.
Figure 2:
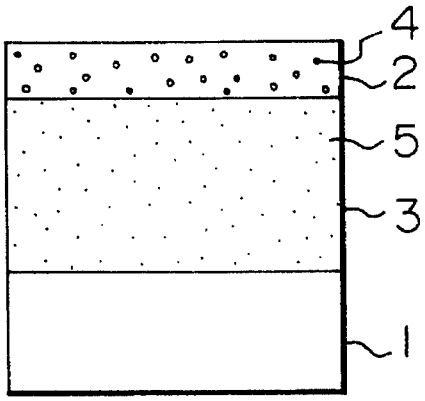
FIG. 2 is a cross-sectional view of another example of the organic electrophotographic photoreceptor of this invention and shows that the photosensitive layer has a positively charged, function-separated type, double layer structure which is the reverse structure of FIG. 1.
Figure 3:
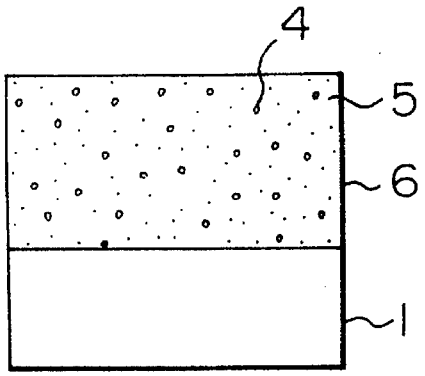
FIG. 3 is a cross-sectional view of still another example of the organic electrophotographic photoreceptor of this invention and shows that the photosensitive layer has a dispersion type monolayer structure having a photosensitive layer 6 in which a charge-generating material 4 and a charge-transfer material 5 are mixed and dispersed.

Specifically, a function-separated type organic photoreceptor having the same construction as the photoreceptor of FIG. 1 in which a charge-generating layer and a charge-transfer layer are laminated to an electroconductive support is obtained by vapor-depositing a charge-generating material on the electroconductive support or applying to the electroconductive support a coating solution prepared by dissolving or dispersing a charge-generating material in a suitable solvent containing, if necessary, a binder dissolved therein; drying the coating solution to form a charge-generating layer; then applying onto the charge-generating layer a solution prepared by dissolving a diaminodiphenyl compound of the general formula (I) as a charge-transfer material and a binder resin in a suitable solvent; and thereafter drying the same to form a charge-transfer layer. In this case, the thickness of the charge-generating layer is preferably 5 μm or less, more preferably 2 μm or less, and the thickness of the charge-transfer layer is preferably 3 to 40 μm, more preferably 5 to 20 μm.

The proportion of the diaminodiphenyl compound in the charge-transfer layer is preferably 0.3 to 2 parts by weight, more preferably 0.5 to 1.5 parts by weight, per part by weight of the binder resin. Other charge-transfer materials such as a hydrazone compound and the like may be used in combination with the diaminodiphenyl compound. In the case of a high polymer charge-transfer material which per se can be used as a binder, other binders need not be used.

The construction of the function-separated type organic photoreceptor may also be such that the charge-transfer layer is formed on the electroconductive support and the charge-generating layer is laminated onto the charge-transfer layer.

A dispersion type organic photoreceptor (referred to hereinafter as dispersion type organic photoreceptor in some cases) in which a photoconductive layer (or photosensitive layer) is formed on an electroconductive support is obtained by dispersing fine particles of a photoconductive material in a solution of the diaminodiphenyl compound and the binder resin in a solvent; applying the dispersion to the electroconductive support; and drying the same to form the photoconductive layer. In this case, the thickness of the photoconductive layer is preferably 3 to 40 μm, more preferably 5 to 20 μm.

When the amount of the photoconductive material used is too small, the sensitivity becomes low and when it is too large, the electrification becomes low and the strength of the photoconductive layer becomes low. Thus, the amount of the photoconductive material in the photoconductive layer is preferably 0.01 to 2 parts by weight, more preferably 0.05 to 1 part by weight, per part by weight of the resin. The amount of the diaminodiphenyl compound in the photo-conductive layer is preferably 0.01 to 2 parts by weight, more preferably 0.02 to 1.2 parts by weight, per part by weight of the resin. The diaminodiphenyl compound may be used in combination with a high polymer photoconductive material which can per se be used as a binder. Moreover, it may be used in combination with another charge-transfer materials such as a hydrazone compound.

As the charge-generating material in the function-separated type organic electrophotographic photoreceptor of this invention or as the photoconductive material in the dispersion type organic electrophotographic photoreceptor of this invention, there may be used organic pigments or dyes such as bisazo pigments, triarylmethane dyes, thiazine dyes, oxazine dyes, xanthene dyes, cyanine coloring matters, styryl coloring matters, pyrylium dyes, azo pigments, quinacridone pigments, indigo pigments, perylene pigments, polycyclic quinone pigments, bisbenzimidazole pigments, indanthrene pigments, squarilium pigments, phthalocyanine pigments and the like; and such inorganic substances as selenium, selenium.tellurium, selenium.arsenic, cadmium sulfide, amorphous silicon and the like.

Any other materials which absorb light to generate charge carriers at a high efficiency can be used.

As the binder, there can be used all electrically insulating, thermoplastic resins and thermosetting resins which are per se known, and also, photosetting resins and photoconductive resins can be used.

Examples of suitable binder resins are thermoplastic binders such as saturated polyester resins, polyamide resins, acrylic resins, ethylene-vinyl acetate copolymers, ion-crosslinked olefin copolymers (ionomers), styrene-butadiene block copolymers, polyarylates, polycarbonates, vinyl chloride-vinyl acetate copolymers, cellulose esters, polyimides, styrene resins and the like; thermosetting binders such as epoxy resins, urethane resins, silicone resins, phenol resins, melamine resins, xylene resins, alkyd resins, thermosetting acrylic resins and the like; photosetting resins such as ultraviolet-setting resin and the like; photoconductive resins such as poly-N-vinyl-carbazole, polyvinylpyrenes, polyvinylanthrathenes and the like; etc.

These may be used alone or in admixture of two or more. These electrically insulating resins have preferably a volume resistivity of $1\times10^{12}$ Ω.cm or more as measured alone. More preferable resins are saturated polyester resins, polycarbonates and acrylic resins. As the solvent, there can be used alcohol solvents, for example, lower alcohols such as methanol, ethanol, propanol, butanol, pentanol and the like; ether solvents such as dioxane, tetrahydrofuran and the like; ketone solvents such as acetone, methyl ethyl ketone, cyclohexanone and the like; and chlorinated hydrocarbons such as dichloromethane, chloroform, carbon tetrachloride and the like.

In the organic electrophotographic photoreceptor of this invention, there may be used, together with the binder, a plasticizer such as a halogenated paraffin, polybiphenyl chloride, dimethylnaphthalene, dibutyl phthalate, o-terphenyl or the like; an electron attractive sensitizing agent such as chloranil, tetracyanoethylene, 2,4,7-trinitro-9-fluorenone, 5,6-dicyanobenzoquinone, tetracyanoquinodimethane, tetrachlorophthalic anhydride, 3,5-dinitrobenzoic acid or the like; and a sensitizing agent such as Methyl Violet, Rhodamine B, cyanine dye, pyrylium salt, thiapyrylium salt or the like.

In the charge-transfer layer of this invention, various additives may be contained, which include phenol type antioxidants such as 2-tert-butyl-4-methoxyphenol, 2,6-di-tert-butylphenol, 2,6-di-tert-butyl-4-methylphenol, 2,6-di-tert-butyl-4-ethylphenol, 2,6-di-tert-butyl-4-butylphenol and the like. These phenol type antioxidants inhibit cracks from being caused owing to adhesion of oil, fingerprints or the like to the surface of the photoreceptor and enhance the ozone resistance, the stability of the coating solution and the repeating characteristics and photo-induced fatigue characteristics as an electrophotographic photoreceptor without impairing the fundamental characteristics as an organic photoreceptor. In particular, a phenol type antioxidant having a molecular weight of 200 to 1,000 is effective, and it is preferable to dissolve the antioxidant in an amount of 1 to 20% by weight based on the weight of the diaminodiphenyl compound in the coating solution. When the amount of the antioxidant is less than 1% by weight, cracks are caused and when it exceeds 20% by weight, the residual potential becomes high.

The charge-transfer layer may contain at least one electron accepting substance. As the electron accepting substance, there are mentioned, for example, anthracene, diphenoquinone derivatives, stilbenequinone derivatives, phthalic acid, maleic acid, acridine and the like.

The amount of the electron accepting substance is preferably 3% by weight or less, more preferably 0.2 to 2% by weight, based on the weight of the charge-transfer agent in the charge-transfer layer.

The above-mentioned pigment dispersion can be obtained by dry kneading and grinding the bisazo pigment and the binder by a known method using a ball mill, an Attoritor or the like and then continuously dispersing them together with the solvent using a dispersing means such as a sand mill or the like. The thus obtained dispersion in which the pigment is dispersed is coated by a coating method such as a blade coating method, a Mayer bar coating method, a spray coating method, an immersion coating method, a curtain coating method, a bead coating method or the like. This coating method can be used in the formation of the charge-transfer layer which will be stated hereinafter. The film thickness of the charge-generating layer is preferably 5 μm or less, more preferably 0.1 to 2 μm.

DESCRIPTION OF THE PREFERRED EMBODIMENTS

This invention is explained in more detail below by way of Examples; however, this invention should not be construed to be limited thereto.

EXAMPLE 1

A phthalocyanine pigment and a resinous polyvinyl butyral were dry kneaded at a weight ratio of 2/1, thereafter dispersed in a solvent consisting of dioxane and acetone (8/2 weight ratio) in a solid content of 10% by weight for ten hours to prepare a coating solution. This was coated on an aluminum drum substrate by an immersion coating method and dried to form a charge-generating layer. The film thickness of the resulting charge-generating layer was 0.3 μm.

Subsequently, the diaminodiphenyl compound (1) shown in Table 1 and a polycarbonate were dissolved at a weight ratio of 1/1 in dichloromethane to prepare a solution having a solid content of 25% by weight, and 2,6-di-tert-butyl-4-methylphenol as an antioxidant was dissolved therein in a proportion of 10% by weight based on the weight of the diaminodiphenyl compound to prepare a coating solution. This coating solution was applied onto the charge-generating layer by an immersion coating method and then dried to form a charge-transfer layer. The film thickness of the charge-transfer layer was 21 μm.

The photoreceptor thus obtained was subjected to corona discharge at −5 kv and the surface potential at this time (initial potential $V_0$) was measured. This photoreceptor was further allowed to stand in a dark place for 10 seconds, and thereafter, subjected to measurement of surface potential ($V_{10}$) to determine $V_{10}/V_0$ [this ratio is referred to hereinafter as a dark decay ratio (DDR)].

The sensitivity was evaluated by measuring the half-decay exposure [T/2 (lux.sec)]which is the exposure necessary to decay the surface potential of −700 V to ½. In this case, a halogen lamp was used as a light source. The results obtained are shown in Table 2.

EXAMPLE 2

The same procedure as in Example 1 was repeated, except that a bisazo pigment was substituted for the phthalocyanine pigment and the diaminodiphenyl compound (2) shown in Table 1 was substituted for the diaminodiphenyl compound (1) to prepare a photoreceptor, and electro-photographic characteristics were measured in the same manner as in Example 1. The results obtained are shown in Table 2.

EXAMPLE 3

The same procedure as in Example 1 was repeated, except that a styryl pigment was substituted for the phthalocyanine pigment and the diaminodiphenyl compound (3) shown in Table 1 was substituted for the diaminodiphenyl compound (1), to prepare a photoreceptor, and electrophotographic characteristics were measured in the same manner as in Example 1. The results obtained are shown in Table 2.

EXAMPLE 4

The same procedure as in Example 1 was repeated, except that an indigo pigment was substituted for the phthalocyanine pigment and the diaminodiphenyl compound (4) shown in Table 1 was substituted for the diaminodiphenyl compound (1), to prepare a photoreceptor, and electrophotographic characteristics were measured in the same manner as in Example 1. The results obtained are shown in Table 2.

EXAMPLE 5

A polyamide resin represented by the following formula (TORESIN F30 manufactured by Teikoku Kagaku Sangyo K. K. ):

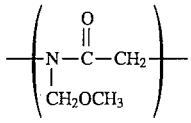

was applied in a thickness of 5 μm to an aluminum drum substrate by an immersion coating method to form an intermediate layer and then a photoreceptor was formed on the intermediate layer in quite the same manner as in Example 1. Electrophotographic characteristics were measured in the same manner as in Example 1 to obtain the results shown in Table 2.

EXAMPLE 6

The same procedure as in Example 1 was repeated, except that 3,5-dimethyl-3',5'-di-tert-butyl-4',4'-diphenoquinone (which is a diphenoquinone derivative) was added in a proportion of 1% by weight as an electron acceptor to the diaminodiphenyl compound (1) mentioned above to prepare a electrophotoreceptor, and photographic characteristics were measured in the same manner as in Example 1, to obtain the results shown in Table 2.

Comparative Example 1

The same procedure as in Example 1 was repeated, except that the known charge-transfer material No. 1 shown in Table 3 was substituted for the diaminodiphenyl compound (1), to prepare a photoreceptor, and electrophotographic characteristics were measured in the same manner as in Example 1 to obtain the results shown in Table 2.

Comparative Example 2

The same procedure as in Example 1 was repeated, except that the known charge-transfer material No. 2 shown in Table 3 was substituted for the diaminodiphenyl compound (1), to prepare a photoreceptor, and electrophotographic characteristics were measured in the same manner as in Example 1 to obtain the results shown in Table 2.

Comparative Example 3

The same procedure as in Example 1 was repeated, except that the known charge-transfer material No. 3 shown in Table 3 was substituted for the diaminodiphenyl compound (1), to prepare a photoreceptor, and electrophotographic characteristics were measured in the same manner as in Example 1 to obtain the results shown in Table 2.

Comparative Example 4

The same procedure as in Example 1 was repeated, except that the known charge-transfer material No. 4 shown in Table 3 was substituted for the diaminodiphenyl compound (1), to prepare a photoreceptor, and electrophotographic characteristics were measured in the same manner as in Example 1 to obtain the results shown in Table 2.

TABLE 2

| | $V_0$ (V) | DDR ($V_{10}/V_0$) (%) | VR (V) | T/2 (Lux · sec) |
|---|---|---|---|---|
| Example 1 | 725 | 95.0 | 10 | 0.8 |
| Example 2 | 675 | 92.0 | 15 | 0.8 |
| Example 3 | 660 | 90.0 | 40 | 1.0 |
| Example 4 | 745 | 92.5 | 40 | 1.0 |
| Example 5 | 535 | 90.0 | 40 | 1.0 |
| Example 6 | 730 | 90.0 | 40 | 1.0 |
| Comp. Ex. 1 | 680 | 85.0 | 30 | 1.3 |
| Comp. Ex. 2 | 680 | 80.0 | 80 | 2.4 |
| Comp. Ex. 3 | 700 | 90.0 | 80 | 2.3 |
| Comp. Ex. 4 | 650 | 70.0 | 90 | 2.5 |

Note:
VR: Residual potential (charge and discharge were repeated while exposing to white light of 300 lux and the potential after the discharge was measured after 100 cycles.)

TABLE 3

Known charge-transfer materials

No. 1

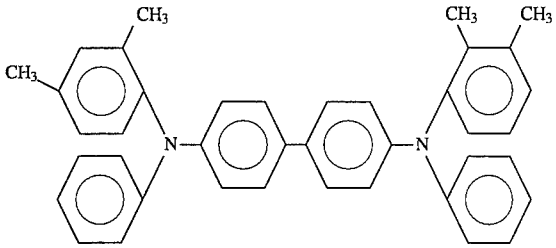

No. 2

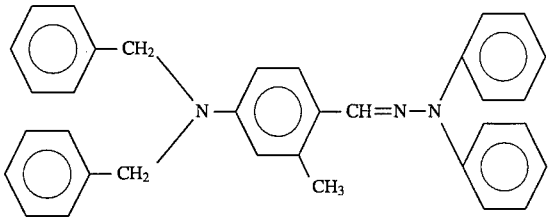

No. 3

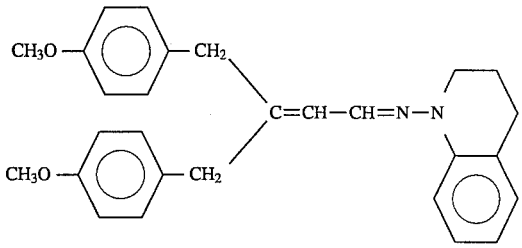

No. 4

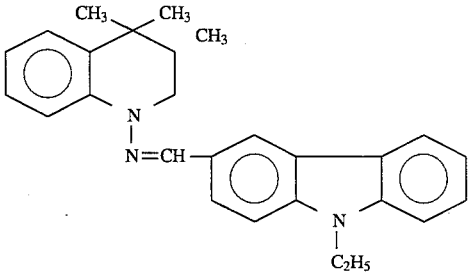

As shown in Table 2, the organic electrophotographic photoreceptors of Comparative Examples 1 to 4 are all low in sensitivity and high in residual potential. On the other hand, the organic electrophotographic photoreceptors of Examples 1 to 6 are all high in sensitivity and low in residual potential.

The organic electrophotographic photoreceptor of Example 5 in which an intermediate layer has been formed is freed from image defects such as fog, black spot and the like in the reversal development, and hence, the intermediate layer has an effect of improving the image quality.

The organic electrophotographic photoreceptor of Example 6 in which an electron acceptor has been contained in the charge-transfer layer has such characteristics that the sensitivity is not lowered and the photolysis is little.

The reason why the organic electrophotographic photoreceptors of Examples 1 to 6 have high sensitivity is considered to be as follows:

Generally, organic electrophotographic photoreceptors are classified into a function-separated type and a dispersion type as mentioned above. In the case of the dispersion type, incident light is absorbed in the whole area of the photosensitive layer to generate carrier pairs of hole and electron, which are separated under an electric field to reach electrodes of opposite pole, upon which the charge is decayed.

In the case of the function-separated type in the Examples, the function of the charge-generating layer and the function of the charge-transfer layer are separated. Incident light is absorbed in the charge-generating layer, carrier pairs of hole and electron are formed, and under an electric field formed by application of negative charge, the holes are injected into the charge-transfer layer and move in the charge-transfer layer to reach the surface of the photoreceptor, upon which the charge is decayed.

In the charge-transfer layer in which the diaminodiphenyl compounds of the formula (I) (charge-transfer materials) in Examples 1 to 6 are used, the energy barrier when the holes generated is injected (transited) from the charge-generating layer to the charge-transfer layer is very small, and hence, the holes are injected efficiently and moved to the surface of the photoreceptor, so that the sensitivity is high.

The organic electrophotographic photoreceptor of this invention has a construction as mentioned above and, as is clear from the above Examples, can effectively inhibit photo-induced fatigue and exhibits stable repeating characteristics and high photosensitivity. That is to say, the organic electrophotographic photoreceptor of this invention is excellent in charge characteristics, sensitivity characteristics and image characteristics, and even when it is repeatedly used, the photo-induced fatigue degradation is a little and the durability is excellent, so that this invention can be said to be very useful.

What is claimed is:

1. An electrophotographic photoreceptor which comprises an electroconductive support having formed thereon a photosensitive layer comprising as essential components a charge-generating material and at least one diaminodiphenyl compound represented by the general formula (I):

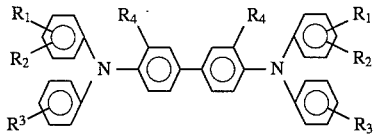

[I]

wherein the two $R_1$ groups may be the same as or different from each other and each is a halogen atom, an alkyl group, an alkoxy group, an aralkyl group, a phenyl group or a phenyl group substituted by a lower alkyl or alkoxy group having 1 to 5 carbon atoms; the two $R_2$ groups may be the same as or different from each other and each is a halogen atom, an alkyl group, an alkoxy group, an aralkyl group, a cycloalkyl group, a phenyl group or a phenyl group substituted by a lower alkyl or alkoxy group having 1 to 5 carbon atoms; the two $R_3$ groups may be the same as or different from each other and each is a hydrogen atom, a halogen atom, an alkyl group, an alkoxy group or an aralkyl group; the two $R_4$ groups may be the same as or different from each other and each is a hydrogen atom, a chlorine atom, a methyl group or a methoxy group; and $R_1$ and $R_2$ are different from each other.

2. The electrophotographic photoreceptor according to claim 1, wherein each $R_1$ group is a methyl group, a methoxy group, a phenyl group, a pentadecyl group, a methoxy group or a halogen atom.

3. The electrophotographic photoreceptor according to claim 1, wherein each $R_2$ group is a methyl group or an ethyl group.

4. The electrophotographic photoreceptor according to claim 1, wherein each $R_3$ group is a hydrogen atom or a methyl group.

5. The electrophotographic photoreceptor according to claim 1, wherein each $R_4$ group is a hydrogen atom or a methyl group.

6. The electrophotographic photoreceptor according to claim 1, wherein the charge-generating material is a bisazo pigment.

7. The electrophotographic photoreceptor according to claim 1, wherein the charge-generating material is indigo pigment.

8. The electrophotographic photoreceptor according to claim 1, wherein the charge-generating material is a phthalocyanine pigment.

9. The electrophotographic photoreceptor according to claim 1, wherein the photosensitive layer is composed of two layers one of which contains the charge generating material and the other layer contains the at least one diaminodiphenyl compound of the general formula (I).

10. The electrophotographic photoreceptor according to claim 1, wherein the photosensitive layer contains a phenol type antioxidant in a proportion of 1 to 20% by weight based on the weight of the diaminodiphenyl compound of the formula (I).

11. The electrophotographic photoreceptor according to claim 10, wherein the phenol type antioxidant is at least one member selected from the group consisting of 2-tert-butyl-4-methoxyphenol, 2,6-di-tert-butylphenol, 2,6-di-tert-butyl-4-methylphenol, 2,6-di-tert-butyl-4-ethylphenol and 2,6-di-tert-butyl-4-butylphenol.

12. The electrophotographic photoreceptor according to claim 1, wherein an intermediate layer is provided between the electroconductive support and the photosensitive layer.

13. The electrophotographic photoreceptor according to claim 12, wherein the intermediate layer contains at least one compound selected from the group consisting of aluminum oxide, indium oxide, tin oxide, polyethylene, an acrylic resin, an epoxy resin, a polycarbonate, a polyurethane, a vinyl chloride resin, a vinyl acetate resin, polyvinyl alcohol and a polyamide resin.

* * * * *